US005577718A

United States Patent [19]

Hatch

[11] Patent Number: 5,577,718

[45] Date of Patent: Nov. 26, 1996

[54] COLLATOR APPARATUS WITH ROTARY PRINTER

[75] Inventor: Terrence Hatch, South Beloit, Ill.

[73] Assignee: R. T. Blackhawk Machine Products, Inc., S. Beloit, Ill.

[21] Appl. No.: 419,186

[22] Filed: Apr. 10, 1995

[51] Int. Cl.[6] ..... B41F 13/54; B41F 13/24

[52] U.S. Cl. ..... 270/1.01; 101/235

[58] Field of Search ..... 101/233, 234, 101/235, 236, 245; 270/1.1, 10

[56] References Cited

U.S. PATENT DOCUMENTS

| | | | |
|---|---|---|---|
| 468,775 | 2/1892 | Ethridge | 101/236 |
| 1,054,223 | 2/1913 | Lynch et al. | 101/236 X |
| 1,556,218 | 10/1925 | Hansen | 101/236 |
| 1,596,967 | 8/1926 | Hansen | 101/235 |
| 1,756,647 | 4/1930 | Lefebvre | 101/235 |
| 2,683,413 | 7/1954 | Muller | 101/235 |
| 2,929,318 | 3/1960 | Pannier | 101/245 X |
| 3,537,393 | 11/1970 | Hegi | 101/235 |
| 3,998,151 | 12/1976 | Friedman | 101/235 X |
| 4,334,471 | 6/1982 | Noyes et al. | 101/235 X |
| 4,470,349 | 9/1984 | Godlewski | 101/233 |
| 4,627,342 | 12/1986 | Yui | 101/235 X |

*Primary Examiner*—John E. Ryznic
*Attorney, Agent, or Firm*—David J. Archer

[57] ABSTRACT

A collator apparatus is disclosed for assembling a plurality of continuous forms into a sequence of multi-layer forms. The apparatus includes a numbering device which is disposed adjacent to the sequence of forms for applying a number to a first form of the sequence. The device includes a numbering wheel having an axis of rotation disposed normal to a direction of movement of the sequence of forms past the wheel, the wheel defining a peripheral surface. A printing device is secured to the peripheral surface for printing the number of the first form when the printing device contacts the first form during mutual movement of the printing device and the first form. A locking mechanism is operably connected to the wheel for selectively locking the wheel against rotation thereof. The locking mechanism locks the wheel in a first rotational disposition of the printing device until the first form reaches a first location relative to the first disposition. A driving device is drivingly connected to the wheel for rotating the wheel from the first disposition when the first form reaches the first location. The arrangement is such that the wheel is rotated by the driving device at a peripheral speed which is the same as a linear velocity of the first form past the numbering device so that the printing device prints the number on the first form when the printing device reaches a second rotational disposition thereof. A further driving device is drivingly connected to the wheel for accelerating rotation of the wheel to complete one revolution of the wheel. The arrangement is such that when the revolution of the wheel is completed, the locking mechanism again locks the wheel against further rotation thereof so that the printing device is in the first disposition thereof until a second multi-layer form of the sequence reaches the first location.

11 Claims, 3 Drawing Sheets

COLLATOR APPARATUS WITH ROTARY PRINTER

BACKGROUND OF THE INVENTION

1. Field of the Invention

The present invention relates to a collator apparatus for assembling a plurality of continuous forms into a sequence of multi-layer forms.

More specifically, the present invention relates to a numbering device for a collator apparatus.

2. Information Disclosure Statement

Collators are machines for assembling together a plurality of continuous forms into a sequence of multi-layer forms. For example, in a business transaction, when an invoice is sent to a customer the invoice is usually typed on a multi-layer form. More specifically, the top copy receives the type print and is sent to the customer together with a pressure sensitive copy thereof on the layer immediately under the top copy.

Also, a further pressure sensitive copy which is disposed immediately under the pressure sensitive customer copy is retained by the supplier for accounts records.

In a large establishment, many invoices will be generated and it is usual for the aforementioned multi-layer forms to be assembled together and printed with an invoice number prior to feeding such blank multi-layer forms to a printing machine for printing the invoice information thereon.

However, a problem exists in that multi-layer forms are made in various form lengths for different types of invoices. Accordingly, separate individual numbering units are required in order to be able to handle the various form lengths because they require different radius wheels for supporting the numbers in order to match the speed of the paper while keeping the printed number in synchronism with the form to be printed.

The present invention overcomes the aforementioned problem of requiring a plurality of different numbering wheels. Accordingly, in the collator of the present invention, only a single wheel is required, the movement of which can be altered to synchronize with any length form.

Other objects and advantages of the present invention will be readily understood by those skilled in the art by a consideration of the detailed description contained hereinafter taken in conjunction with the annexed drawings.

SUMMARY OF THE INVENTION

The present invention relates to a collator apparatus for assembling a plurality of continuous forms into a sequence of multi-layer forms.

More specifically, the apparatus includes a numbering means which is disposed adjacent to the sequence of forms for applying a number to a first form of the sequence.

The numbering means includes a numbering wheel having an axis of rotation disposed normal to a direction of movement of the sequence of forms past the peripheral surface of the wheel.

Printing means are secured to the peripheral surface for printing the number on the first form when the printing means contacts the first form during mutual movement of the printing means and the first form.

Locking means are operably connected to the wheel for selectively locking the wheel against rotation thereof. The locking means locks the wheel in a first rotational disposition of the printing means until the first form reaches a first location relative to the first disposition.

Driving means are drivingly connected to the wheel for rotating the wheel from the first disposition when the first form reaches the first location. The arrangement is such that the wheel is rotated by the driving means at a peripheral speed which is the same as a linear velocity of the first form past the numbering means. The printing means prints the number on the first form when the printing means reaches a second rotational disposition thereof.

A further driving means is drivingly connected to the wheel for accelerating rotation of the wheel to complete one revolution of the wheel. The arrangement is such that when the revolution of the wheel is completed, the locking means again locks the wheel against further rotation thereof so that the printing means is in the first disposition thereof until a second multi-layer form of the sequence reaches the first location.

In a more specific embodiment of the present invention, the numbering wheel is disposed above of the sequence of forms and the printing means is rigidly secured to the surface. The printing means includes type face for printing sequential numbers on each multi-layer form of the sequence while the forms move progressively past the numbering means.

The locking means includes a pawl biased towards the wheel and a notch defined by the wheel. The notch cooperates with the pawl such that when the printing means is disposed in the first disposition thereof, the pawl engages the notch for preventing rotation of the wheel.

Furthermore, the locking means includes release means for controllably releasing the wheel from being locked against rotation thereof so that rotation of the printing means from the first disposition to the second disposition for printing is permitted and for permitting further rotation of the printing means to the first disposition thereof to complete the revolution.

The apparatus also includes sensing means for sensing when each of the forms of the sequence reaches the first location thereof. The sensing means generates a signal and a transmitting means interconnects the sensing means and the locking means such that the signal permits a release of the locking means so that the driving means rotates the printing means from the first to the second disposition thereof.

The wheel is connected to a slipping clutch mechanism having an input and an output. The input is drivably connected to the driving means and the output is drivingly connected to the wheel. The arrangement is such that when the driving means is rotating, the slipping clutch mechanism rotates the wheel so that the printing means moves to the second disposition thereof unless the wheel is locked against rotation in which case the input slips relative to the output.

More specifically, the driving means includes a motor which is preferably an electric motor.

The driving means transmits a constant torque to the wheel for urging the printing means from the first to the second disposition thereof for printing. The constant torque is applied when the wheel is being locked against rotation and when rotated at the peripheral speed.

The further driving means includes a further motor. The further motor is also drivingly connected to the wheel. The arrangement is such that when the further motor is rotating, the further motor rotates the wheel for accelerating the wheel from the second to the first disposition thereof of the printing means unless the wheel is locked against rotation. More specifically, the further motor drives the input by means of a belt or chain. The belt or chain also interconnects the motor and the input. However, a unidirectional overrunning clutch is disposed between the motor and the belt or chain such that the further motor overrides the motor so that when the wheel is being accelerated, the further motor drives the wheel through the slipping clutch mechanism.

BRIEF DESCRIPTION OF THE DRAWINGS

Similar reference characters refer to similar parts throughout the various views of the drawings.

DETAILED DESCRIPTION OF THE DRAWINGS

Figure 1:
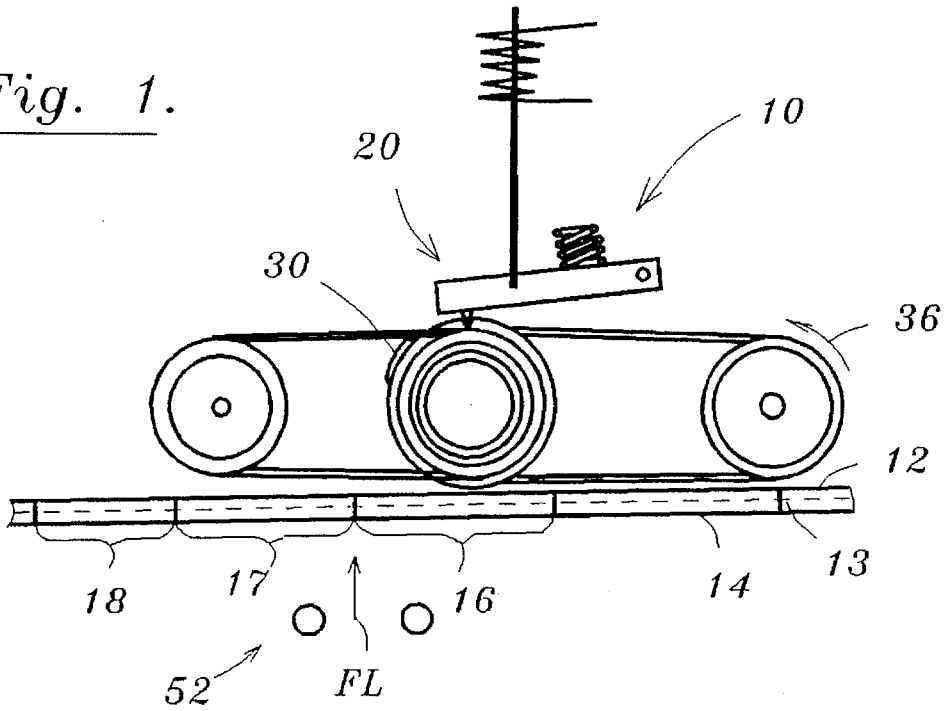
FIG. 1 is a side elevational view of a collator apparatus according to the present invention.

FIG. 1 is a side elevational view of a collator apparatus generally designated 10 according to the present invention for assembling a plurality of continuous forms 12, 13 and 14 into a sequence of 16, 17 and 18 of multi-layer forms.

The apparatus 10 includes a numbering means generally designated 20 disposed adjacent to the sequence of forms 16–18 for applying a number to a first form 16 of the sequence.

Figure 2:
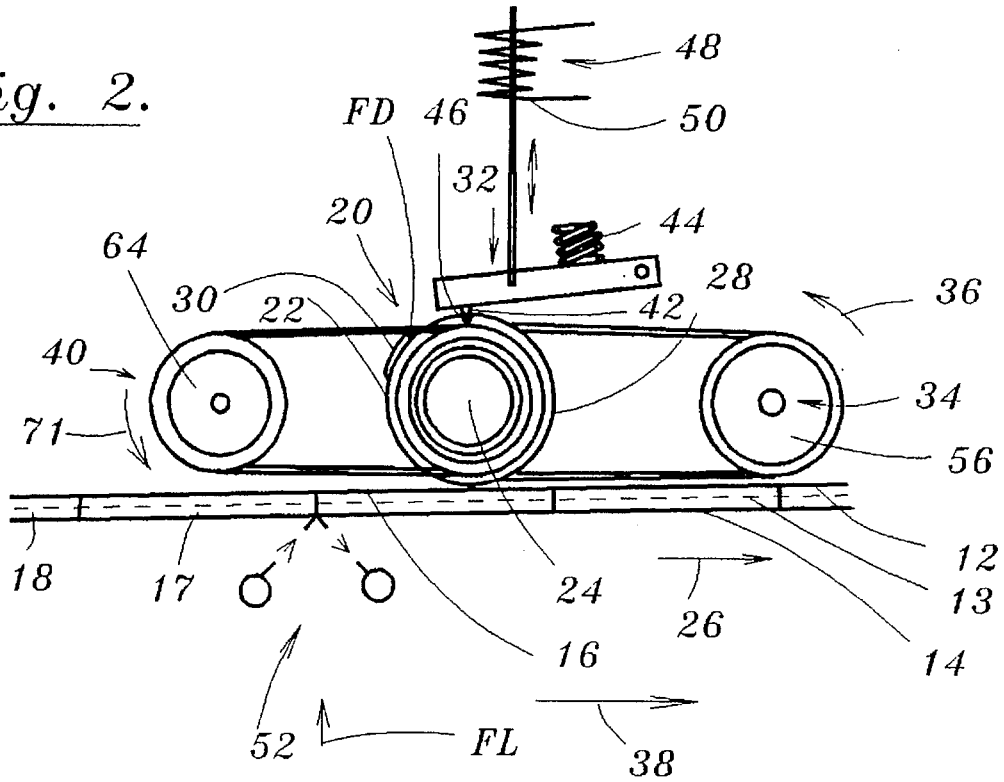
FIG. 2 is an enlarged side elevational view of a numbering means of the collator apparatus shown in FIG. 1.

FIG. 2 is an enlarged side elevational view of the numbering means 20 shown in FIG. 1. The numbering means 20 includes a numbering wheel 22 having an axis of rotation 24 disposed normal to a direction 5of movement 26 of the sequence of forms 16–18 past the wheel 22. The wheel 22 defines a peripheral surface 28.

Printing means 30 are secured to the peripheral surface 28 for printing the number on the first form 16 when the printing means 30 contacts the first form 16 during mutual movement of the printing means 30 and the first form 16.

Locking means generally designated 32 are operably connected to the wheel 22 for selectively locking the wheel 22 against rotation thereof. The locking means 32 locks the wheel 22 in a first rotational disposition FD of the printing means 30 as shown in FIG. 2 until the first form 16 reaches a first location FL relative to the first disposition FD.

Figure 3:
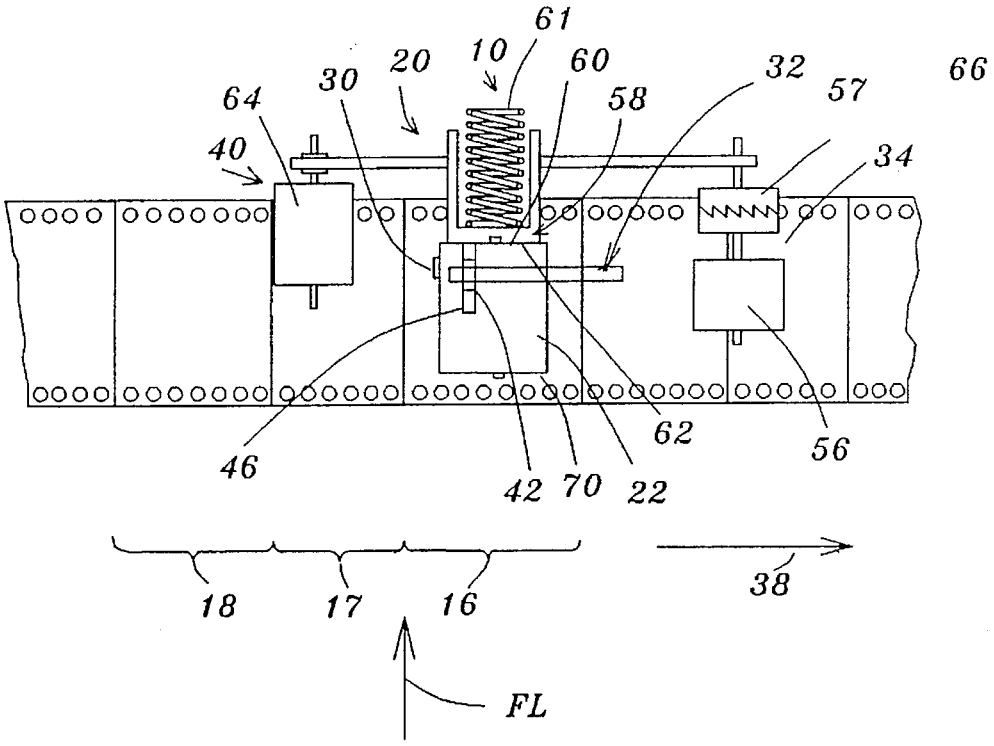
FIG. 3 is a top plan view of the numbering means shown in FIG. 1.
Figure 4:
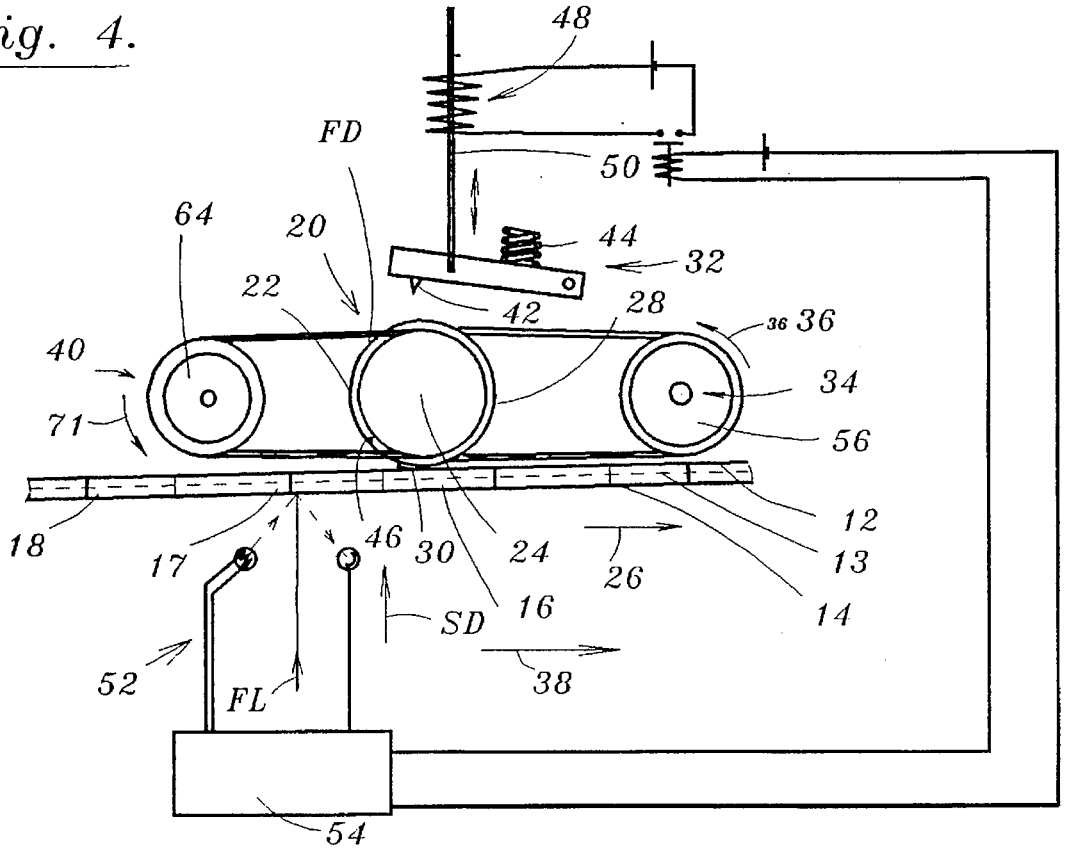
FIG. 4 is a similar view to that shown in FIG. 2 but shows the printing means having moved to the second disposition thereof for printing.

FIG. 3. is a plan view of the apparatus 10 shown in FIG. 1. As shown in FIG. 3 driving means generally designated 34 are drivingly connected to the wheel 22 for rotating the wheel 22 from the first disposition FD, shown in FIG. 2 when the first form 16 reaches the first location FL. The arrangement is such that the wheel 22 is rotated by the driving means 34 at a peripheral speed as indicated by the arrow 36 (FIGS. 1, 2 and 4) which is the same as a linear velocity as indicated by the arrow 38 of the first form 16 past the numbering means 20 so that the printing means 30 prints the number on the first form 16 when the printing means 30 reaches a second rotational disposition SD thereof as shown in FIG. 4.

Figure 5:
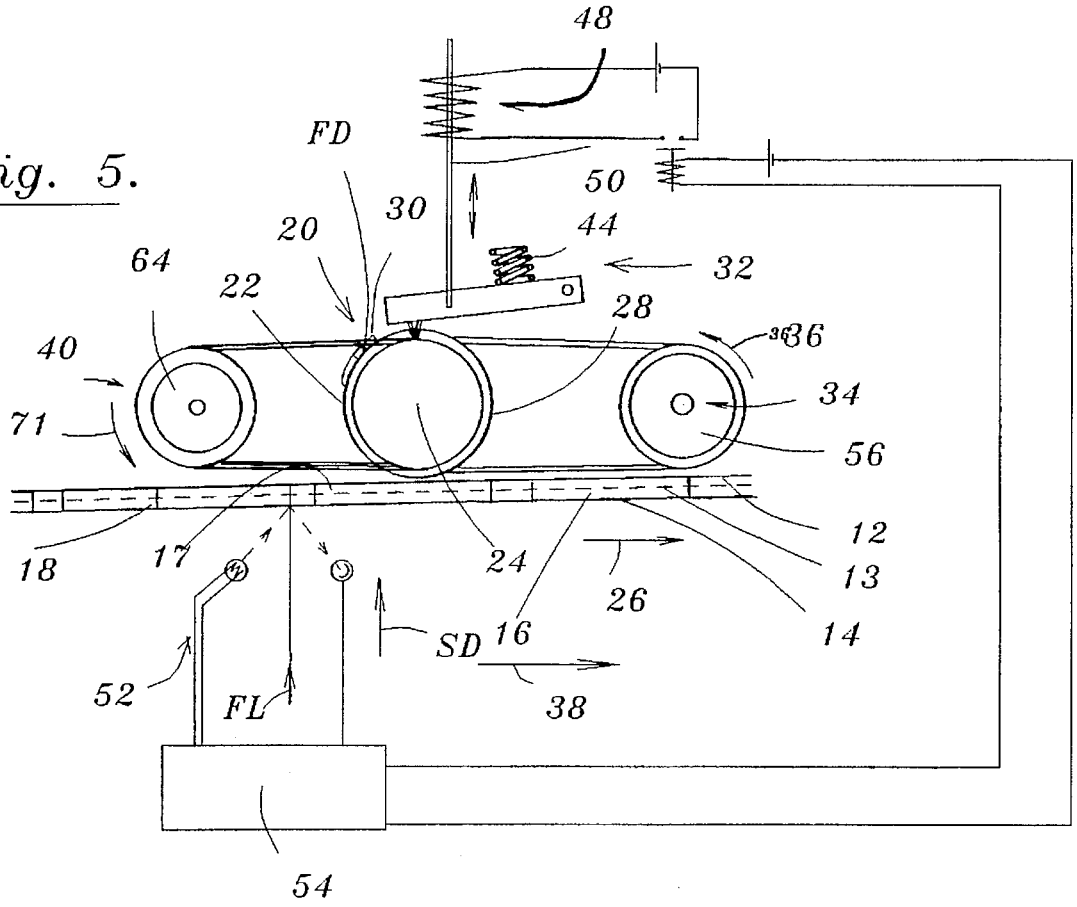
FIG. 5 is a similar view to that shown in FIGS. 2 and 4 but shows a subsequent form having reached a first location thereof.

A further driving means generally designated 40 is drivingly connected to the wheel 22 for accelerating rotation of the wheel 22 to complete one revolution. The arrangement is such that when the revolution of the wheel 22 is completed, the locking means 32 again locks the wheel 22 against further rotation thereof so that the printing means 30 is in the first disposition FD thereof until the second multi-layer form 17 of the sequence reaches the first location FL as shown in FIG. 5.

As shown in FIG. 2, the numbering wheel 22 is disposed above the sequence of forms 16–18.

As shown in FIG. 2, the printing means 30 is rigidly secured to the surface 28. The printing means 30 includes type face for printing sequential numbers such as invoice numbers on each multi-layer form of the sequence 16–18 while the forms 16–18 move progressively past the numbering means 20.

The locking means 32 includes a pawl 42 biased towards the wheel 22. Such biasing may be accomplished by means of a compression spring 44 or the like.

A notch 46 is defined by the wheel 22. The notch 46 cooperates with the pawl 42 such that when the printing means 30 is disposed in the first disposition FD thereof, the pawl 42 engages the notch 46 for preventing rotation of the wheel 22.

The locking means 32 also includes release means generally designated 48 for controllably releasing the wheel 22 from being locked against rotation thereof so that rotation of the printing means 30 from the first disposition FD to the second disposition SD as shown in FIG. 4 is permitted and for permitting continued rotation of the printing means 30 to the first disposition FD thereof to complete the revolution. In a more specific embodiment of the present invention, the release means 48 includes an electromagnetic actuator 50 operably connected to the pawl 42 such that when the actuator 50 is activated, the pawl 42 is moved away from the notch 46 for releasing the wheel 22. When the actuator 50 is de-activated, the pawl 42 is biased by the spring 44 towards the wheel 22 for locking the wheel 22 against rotation when the pawl 42 and the notch 46 interact.

As shown in FIGS. 1–3, the apparatus 10 also includes sensing means generally designated 52 for sensing when each of the forms 16–18 of the sequence reaches the first location FL thereof. The sensing means 52 generates an electrical signal which is transmitted by a transmitting means 54, shown in FIG. 4 inter-connected between the sensing means 52 and the locking means 32. The arrangement is such that the signal permits release of the locking means 32 so that the driving means 34 rotates the printing means 30 from the first disposition FD to the second disposition SD.

The driving means 34 includes a motor 56. A belt or chain 57 is driven by the motor 56. The belt 57 drives an input 60 which is biased by a spring 61 against an output 62. The input 60, spring 61 and output 62 cooperate together as a slipping clutch mechanism generally designated 58 shown in FIG. 3. The input 60 is drivably connected to the motor 56. The output 62 is drivingly connected to the wheel 22. The arrangement is such that when the motor 56 is rotating as shown by arrow 36, the clutch mechanism 58 rotates the wheel 22 so that the printing means 30 moves from the first disposition FD to the second disposition SD respectively unless the wheel 22 is locked against rotation in which case the input 60 slips relative to the output 62.

The driving means 34 applies a constant torque to the wheel 22 for urging the printing means 30 from the first disposition FD to the second disposition SD for priming. The constant torque is applied when the wheel 22 is being locked against rotation and when rotated at the peripheral speed 36.

The further driving means 40 includes a further motor 64. The further motor 64 drives the belt 57 so that when energized, the further motor 64 drives the wheel 22.

A unidirectional overrunning clutch 66 is disposed between the belt 57 and the motor 56 such that when the further motor 64 is energized, the further motor 64 overrides the motor 56 and accelerates the wheel 22 through the slipping clutch 58. More specifically, the arrangement is such that when the further motor 64 is rotating as indicated by arrow 71, the further motor 64 rotates the wheel 22 for accelerating the wheel 22 from the second disposition SD to continue on to the first disposition FD of the printing means 30, unless the wheel 22 is locked against rotation in which case the output 62 slips relative to the input 60. When the further motor 64 is not energized, the further motor 64 free wheels and is driven by the motor 56. Additionally, the motor 56 is connected by means (not shown) for driving the sequence of forms past the numbering system.

The present invention provides a unique numbering system for a collator apparatus which overcomes the need for supplying a plurality of different diameter numbering wheels to accommodate different form lengths.

What is claimed is:

1. A collator apparatus for assembling a plurality of continuous forms into a sequence of multi-layer forms, said apparatus comprising:

a numbering means disposed adjacent to the sequence of forms for applying a number to a first form of the sequence;

said numbering means including:

a numbering wheel having an axis of rotation disposed normal to a direction of movement of the sequence of forms past said wheel, said wheel defining a peripheral surface;

printing means secured to said surface for printing said number on the first form when said printing means contacts the first form during mntual movement of said printing means and the first form;

locking means operably connected to said wheel for selectively locking said wheel against rotation thereof, said locking means locking said wheel in a first rotational disposition of said printing means until the first form reaches a first location relative to said first disposition;

driving means drivingly connected to said wheel for rotating said wheel from said first disposition when the first form reaches said first location, the arrangement being such that said wheel is rotated by said driving means at a peripheral speed which is substantially the same as a linear velocity of the first form past said numbering means so that said printing means prints said number on the first form when said printing means reaches a second rotational disposition thereof; and a further driving means drivingly connected to said wheel for accelerating rotation of said wheel to complete one revolution of said wheel, the arrangement being such that when said revolution of said wheel is completed, said locking means again locks said wheel against further rotation thereof so that said printing means is in said first disposition thereof until a second multi-layer form of the sequence reaches said first location.

2. A collator apparatus as set forth in claim 1 wherein said numbering wheel is disposed above the sequence of forms.

3. A collator apparatus as set forth in claim 1 wherein said printing means is rigidly secured to said surface, said printing means including:

type face for printing sequential numbers on each multi-layer form of the sequence while the forms move progressively past said numbering means.

4. A collator apparatus as set forth in claim 1 wherein said locking means includes:

a pawl biased toward said wheel;

a notch defined by said wheel, said notch cooperating with said pawl such that when said printing means is disposed in said first disposition thereof, said pawl engages said notch for preventing rotation of said wheel.

5. A collator apparatus as set forth in claim 1 wherein said locking means includes:

release means for controllably releasing said wheel from being locked against rotation thereof so that rotation of said printing means from said first disposition to said second disposition for priming is permitted and for permitting continued rotation of said printing means to said first disposition thereof to complete said revolution.

6. A collator apparatus as set forth in claim 4 wherein said locking means further includes:

release means for controllably releasing said wheel from being locked against rotation thereof;

said release means including:

an electromagnetic actuator operably connected to said pawl such that when said actuator is activated, said pawl is moved away from said notch for releasing said wheel and when said actuator is deactivated, said pawl is biased towards said wheel for locking said wheel against rotation when said pawl and notch interact.

7. A collator apparatus as set forth in claim 1 further including:

sensing means for sensing when each of said forms of said sequence reaches said first location thereof, said sensing means generating a signal when each of said forms reach said first location;

transmitting means interconnecting said sensing means and said locking means such that said signal permits release of said locking means so that said driving means rotates said printing means from said first to said second disposition thereof.

8. A collator apparatus as set forth in claim 1 wherein said driving means includes:

a motor;

a slipping clutch mechanism having an input and an output, said input being drivably connected to said motor, said output being drivingly connected to said wheel, the arrangement being such that when said motor is rotating, said clutch mechanism rotates said wheel so that said printing means moves from said first to said second disposition thereof unless said wheel is locked against rotation in which case said output slips relative to said input.

9. A collator apparatus as set forth in claim 8 wherein said driving means applies a constant torque to said wheel for urging said printing means from said first disposition to said second disposition for printing, said constant torque being applied when said wheel is being locked against rotation and when rotated at said peripheral speed.

10. A collator apparatus as set forth in claim 8 wherein said further driving means includes:

a further motor;

a unidirectional overrunning clutch mechanism disposed between said motor and said further motor, the arrangement being such that when said further motor is rotating, said unidirectional clutch mechanism overruns said motor and rotates said wheel for accelerating said wheel from said second to said first disposition of said printing means unless said wheel is locked against rotation in which case said output slips relative to said input.

11. A collator apparatus as set forth in claim 10 wherein said further motor when deenergized is rotated by said motor.

* * * * *

UNITED STATES PATENT AND TRADEMARK OFFICE

CERTIFICATE OF CORRECTION

PATENT NO. : 5,577,718
DATED : Novenber 26, 1996
INVENTOR(S) : Terrence Hatch

It is certified that error appears in the above-indentified patent and that said Letters Patent is hereby corrected as shown below:

Column 3, line 41 delete "5of" and insert therefore --of--
Column 5, line 1 delete "priming" and insert therefore --printing--
Column 6, line 20 delete "priming" and insert therefore --printing--

Signed and Sealed this

Eleventh Day of February, 1997

Bruce Lehman

*Attest:*

BRUCE LEHMAN

*Attesting Officer*

*Commissioner of Patents and Trademarks*